United States Patent [19]

Luke

[11] Patent Number: 4,718,435

[45] Date of Patent: Jan. 12, 1988

[54] SMOKING ARTICLES

[75] Inventor: John A. Luke, Eastleigh, England

[73] Assignee: British-American Tobacco Company, Ltd., London, England

[21] Appl. No.: 945,721

[22] Filed: Dec. 22, 1986

[30] Foreign Application Priority Data

Dec. 23, 1985 [GB] United Kingdom ..... 8531656

[51] Int. Cl.[4] ..... A24C 5/60; A24D 3/04

[52] U.S. Cl. ..... 131/281; 131/94; 131/336; 493/42; 493/43

[58] Field of Search ..... 131/281, 336, 94, 95; 493/42, 43

[56] References Cited

U.S. PATENT DOCUMENTS 4,515,170 5/1985 Cantrell et al. ..... 131/336

*Primary Examiner*—V. Millin

*Attorney, Agent, or Firm*—Charles G. Lamb

[57] ABSTRACT

There is disclosed a method of operating on a cigarette, which comprises a tobacco rod and a filter element interattached by a thermoplastic tipping wrapper, to allow for the ingress of ventilation air. The filter element also comprises ventilation duct(s) extending therewithin. A heated former is brought into contact with the tipping wrapper in such a way as to form indentations which intersect with a ventilation duct(s) of the filter element and to seal upstream end portions thereof.

9 Claims, 3 Drawing Figures

SMOKING ARTICLES

Figure 1:
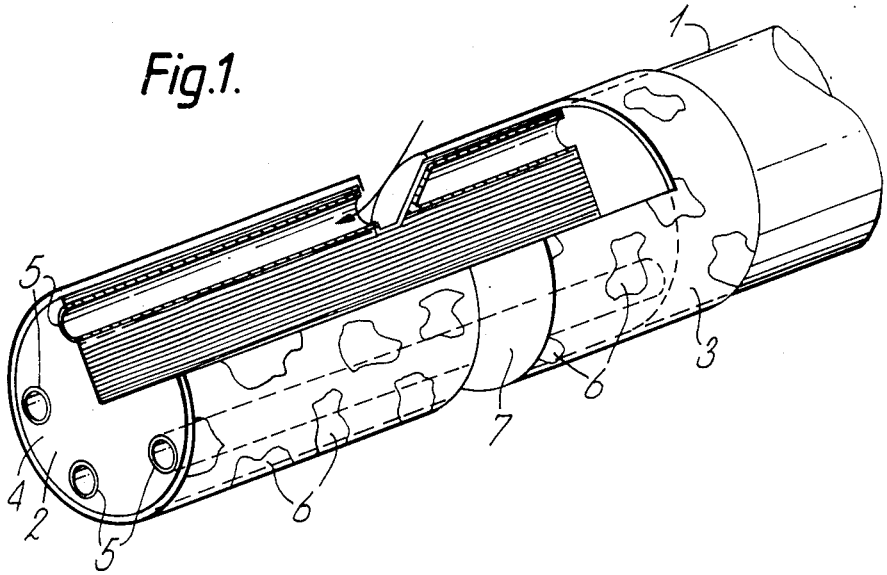

This invention relates to smoking articles comprising ventilated mouthpieces.

It is known from United Kingdom Patent Application Document No. 2 150 409 A to provide a smoking article comprising a mouthpiece in which a ventilation tube extends to the mouth end of the mouthpiece, the upstream end of the tube being in communication with a cavity into which ventilating air can enter through tipping wrapper perforations.

In the specification of United Kingdom Pat. No. 2 046 573 there is described a filter tipped cigarette the filter of which comprises peripheral ventilation grooves which extend to the mouth end of the filter. A ring of perforations in the tipping paper overlie the grooves, whereby ventilating air can be drawn into the grooves when the cigarette is smoked.

In European Patent Document No. 146 114 there is described a filter unit comprising a plug of filtration material which is surrounded by a sleeve comprising inner and outer, radially spaced wrappers interconnected by spacing webs. Ventilation air may be drawn through perforations in the outer wrapper into the channels between the inner and outer wrappers, which space is open at the mouth end of the filter unit.

From U.S. Pat. No. 4,481,954 it is known to modify the peripheral conformation of a cigarette by applying a heated former to the cigarette.

The present invention provides a method of operating upon a smoking article, which article comprises a smoking material rod and a mouthpiece attached to said rod by a tipping wrapper, said mouthpiece comprising a ventilation duct, wherein a heated former is brought into contact with that portion of said smoking article occupied by said tipping wrapper to produce a ventilation indentation and an opening in said indentation intercommunicating said identation and said ventilation duct.

It is advantageous for the tipping wrapper to incorporate a proportion of synthethic thermoplastics material. Such material, which is suitably in the form of filaments or fibres, may be present in the tipping wrapper at an inclusion level of from 25% to 95% by weight, at least a substantial proportion of the balance to 100% preferably being provided by cellulosic fibres. The synthetic thermoplastic material may be a polyolefin, a polyethylene or a polypropylene material for example. The presence in the tipping wrapper of thermoplastics material renders the tipping wrapper thermoformable, whereby material of the tipping wrapper may line at least a part of the ventilation indentation apart, of course, from the opening in the indentation.

The air permeability of the sheet material employed as the tipping wrapper should preferably be of a low order and more preferably the material should be substantially air impermeable.

Preferably the duct should extend through a surrounding matrix material, which matrix material may be a tobacco smoke filtration material, a fibrous or an open-cell foam filtration material for example.

The ventilation duct may take the form of a tube or of a channel in a sleeve generally of a construction as disclosed, for example, in the European Patent Document No. 146 114, the tube or sleeve preferably being formed of a thermoplastic material. A further form which the duct may take is that of a groove formed in a matrix material or in a plugwrap overlying a matrix material.

The ventilation duct preferably extends for the full length of the mouthpiece although it may extend for a length less than the full length. The latter case is especially easy to provide for if the ventilation duct takes the form of a groove.

The duct may extend to the mouth end of the mouthpiece.

The walls of the duct should preferably be substantially air impermeable.

The indentation expediently takes the form of a groove extending fully around the smoking article, the depth of the groove being at least sufficient to provide for the intersection of the ventilation duct by the groove. The indentation is advantageously wholly disposed at that portion of the smoking article occupied by the mouthpiece, although the indentation may extend into that portion of the smoking article occupied by the smoking material rod. Indeed, the indentation may even be wholly disposed in that portion of the smoking material rod which is overlain by the tipping wrapper, so long as the opening in the indentation serves to intercommunicate the indentation and the upstream end of the ventilation duct.

If the indentation is to intersect the ventilation duct over the full depth thereof, suitably the face of the heated former nearer the smoking material rod slopes inwardly towards that portion of the former which is advanced farthest into the smoking article. Thus if the duct takes the form of a thermoplastic tube or sleeve, at the upstream side of the indentation the tube or sleeve is closed by thermal welding.

The ventilation duct may be one of a number of ventilation ducts of the mouthpiece, in which case an equal number of discrete indentations may be provided in carrying out the present inventive method, each of the indentations being associated with a different one of the ventilation ducts.

The present invention also provides a smoking article comprising a smoking material rod, a mouthpiece attached to said rod by a tipping wrapper, a ventilation duct extending within said mouthpiece, an indentation at that portion of the smoking article occupied by said tipping wrapper, and an opening in said indentation intercommunicating said indentation and said ventilation duct.

In order that the invention may be clearly understood and readily carried into effect, reference will now be made, by way of example, to the accompanying diagrammatic drawings, which show in FIGS. 1 and 2 perspective views of tip end portions of cigarettes with, in each case, parts removed to reveal the interior construction of the tip. FIG. 3 shows the cross-section of a former.

The cigarette of FIG. 1 comprises a wrapped tobacco rod 1, only part of the full length of which is shown, a filter tip generally designated 2 and a tipping wrapper 3 which serves to interattach the rod 1 and the filter tip 2.

The filter tip 2 comprises a self-sustaining filter plug 4 of fibrous cellulose acetate providing a tobacco smoke filtration matrix material and five equiangularly spaced tubes 5 of a thermoplastic plastics material. The plug 4 was cut from a continuous filter rod in which the tubes 5 extended continuously. As may be observed from FIG. 1, the tubes 5 are disposed close to the peripheral surface of the plug 4.

The tipping wrapper 3 is thermoformable by virtue of the inclusion therein of a proportion of synthetic thermoplastic fibres. The irregular markings 6 indicate a conventional cork effect printed pattern with which the tipping wrapper 3 is provided.

The cigarette of FIG. 1 is provided with a ventilation indentation in the form of an annular groove 7. As may be seen from the removal in FIG. 1 of a 90° quadrantal portion of the tip 2 and of the overlying wrapper 3, the groove 7 intersects the tubes 5 at a location intermediate the ends of the tip 2 but somewhat closer to the upstream end thereof.

The groove 7 is formed by rotating the cigarette about its longitudinal axis in contact with a heated former having a cross-sectional shape, see FIG. 3, corresponding to that of the groove 7. The heated former may be of arcuate configuration in its longer dimension, in which case the cigarette, as well as being rotated, is moved along a corresponding arcuate path. Thermal moulding apparatus suitable for providing the groove 7 is disclosed in United Kingdom Patent Specification No. 1,507,765.

When the heated former is in contact with the cigarette, a first side face 8 of the former is disposed perpendicularly to the tubes 5 and a second side face 9 of the former is inclined to the tubes 5. This configuration of the former results in each of the tubes 5 being cleanly severed at the downstream side of the groove 7, whereas at the inclined upstream side of the groove 7 each of the tubes 5 is closed. Because of the thermoformable character of the tipping wrapper 3, the walls of the groove 7, except at entry to the downstream portions of the tubes 5, are lined by the wrapper 3.

When the cigarette of FIG. 1 is smoked, ventilation air is drawn into the portion of each of the tubes 5 which extends downstream from the groove 7, which portion provides a ventilation duct, and flows through that portion to exit the mouthpiece 2 at the mouth end thereof. Tobacco smoke passes through the cellulose acetate filter plug 4. It will thus be appreciated that there is complete separation of the smoke and the ventilation air within the mouthpiece 2.

Figure 2:
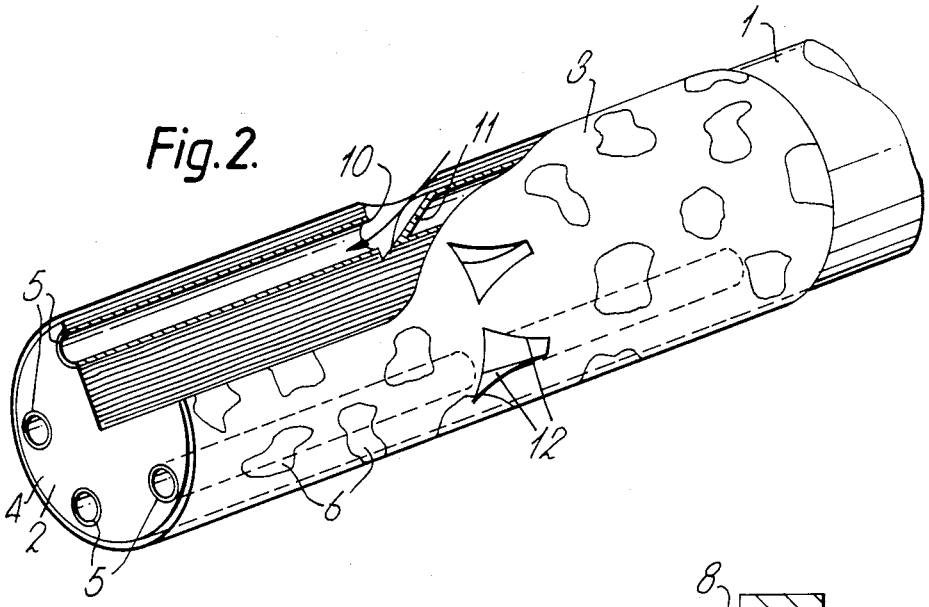
Figure 3:
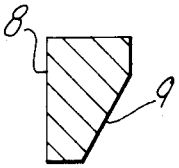

Certain features of the cigarette of FIG. 2 are identical to features of the cigarette of FIG. 1 and are designated by the same reference numerals. Moreover, for the sake of brevity, specific mention will now be made only of the features of difference in the cigarette of FIG. 2.

The cigarette of FIG. 2 is provided with a separate ventilation indentation 10 in association with each of the tubes 5. As may be seen from FIG. 2 each of the indentations 10 is of such configuration that both the depth and the width thereof increase in a direction towards the mouth end of the mouthpiece 2. A bottom wall 11 of each of the indentations 10 is substantially flat and is inclined. Side walls 12 of the indentations 10 follow divergent lines of curvature.

Each of the ventilation indentations 10 is provided by bringing a suitably shaped heated former (not shown) into contact with the cigarette. A downstream side face of the former is perpendicular to the associated tube 5, whereby the tube 5 is clearly severed at the downstream end of the indentation 10, whereas an upstream side face of the former is inclined, whereby there is provided the inclined bottom wall 11. The walls 11 and 12 of each indentation 10 are lined by material of the tipping wrapper 3. As may be seen from FIG. 2, the formation of the indentation 10 causes the upstream portions of the tubes 5 to be closed.

When the cigarette of FIG. 2 is smoked, ventilation air flows into the downstream portion of each of the tubes 5 via the associated ventilation indentation 10.

In a modified form (not shown) of the cigarette of FIG. 2 the side walls of the ventilation indentations converge, rather than diverge, in a direction towards the mouth end of the mouthpiece 2.

Although as above described the upstream portions of the tubes 5 of the cigarettes of FIGS. 1 and 2 are closed, the heated formers used in providing the groove 7 or the indentations 10 could comprise a perpendicular upstream side face so that the upstream portions of the tubes 5, as well as the downstream portions thereof, are in communication with the groove 7 or the associated indentations 10. It is also conceivable to provide for the downstream portions of the tubes 5 to be closed and the upstream portions thereof to be open.

What is claimed is:

1. A method of operating on a smoking article, which article comprises a smoking material rod and a mouthpiece attached to said rod by a tipping wrapper, said mouthpiece comprising a ventilation duct, wherein a heated former is brought into contact with that portion of said smoking article occupied by said tipping wrapper to produce a ventilation indentation and an opening in said indentation intercommunicating said identation and said ventilation duct.

2. A method according to claim 1, wherein said tipping wrapper comprises thermoplastic material.

3. A method according to claim 1, wherein said duct is close to the surface of said mouthpiece.

4. A method according to claim 1, wherein said duct comprises thermoplastic material.

5. A method according to claim 1, wherein said indentation is in the form of an annular groove intersecting said duct.

6. A method according to claim 1, wherein at the upstream side of said indentation said duct is closed by thermal welding.

7. A method according to claim 6, wherein that side of the heated former which is to face the upstream end of said article slopes inwardly towards that portion of the former which is advanced furthest into said article.

8. A method according to claim 1, wherein said duct is one of the plurality of such ducts.

9. A method according to claim 8, wherein said indentation is one of a plurality of discrete indentations, each of which intersects a corresponding duct.

* * * * *